US005460590A

United States Patent [19]

Greiner et al.

[11] Patent Number: 5,460,590

[45] Date of Patent: Oct. 24, 1995

[54] METHOD AND APPARATUS FOR PRODUCING FIBER SKEINS

[75] Inventors: Christoph Greiner, Vörstetten; Thomas Leutner, Herbolzheim; Eberhard Teufel, Gundelfingen, all of Germany

[73] Assignee: Rhone-Poulenc Rhodia Aktiengesellschaft, Freiberg, Germany

[21] Appl. No.: 92,322

[22] Filed: Jul. 14, 1993

[30] Foreign Application Priority Data

Jun. 18, 1993 [DE] Germany ..... 43 20 317.5

[51] Int. Cl.[6] ..... B65H 59/14; B65H 59/16; B65H 59/24

[52] U.S. Cl. ..... 493/4; 493/37; 493/40; 493/50

[58] Field of Search ..... 493/4, 37, 39, 493/42, 44, 49, 50, 40, 45

[56] References Cited

U.S. PATENT DOCUMENTS

| | | | |
|---|---|---|---|
| 3,224,453 | 12/1965 | Mahoney et al. | 131/341 |
| 3,399,606 | 9/1968 | Molins | 493/4 |
| 3,818,809 | 6/1974 | Sylvester | 493/42 |
| 3,960,645 | 6/1976 | Brackmann et al. | 493/42 |
| 3,971,695 | 7/1976 | Block | 493/4 |
| 3,974,007 | 8/1976 | Greve | 493/4 |
| 4,248,139 | 2/1981 | Labbe | 493/4 |
| 4,259,769 | 4/1981 | Greve et al. | 28/283 |
| 4,283,998 | 8/1981 | Greve et al. | 493/4 |
| 4,507,107 | 3/1985 | Berger | 493/45 |
| 4,511,420 | 4/1985 | Arthur | 493/4 |
| 4,526,565 | 7/1985 | Hummel et al. | 493/196 |
| 5,106,357 | 4/1992 | Kampen | 493/44 |

FOREIGN PATENT DOCUMENTS

| | | |
|---|---|---|
| 2521391 | 11/1976 | Germany . |
| 4308093 | 9/1993 | Germany . |
| 469449 | 4/1966 | Switzerland . |

*Primary Examiner*—Jack W. Lavinder
*Attorney, Agent, or Firm*—Bucknam and Archer

[57] ABSTRACT

A method for producing at least one fiber skein for the production of filters for cigarettes and for other smokable rod-shaped articles, comprises the steps of drawing from a supply at least one filter tow strip, supplying the drawn fiber strip to a subsequent treatment, in which the fiber strip is stretched and fluffed, then the treated fiber strip is collected in a formating unit to a fiber skein which is finally provided with an enveloping material, to form a continuous, wrapped fiber skein. The fiber strip of strips are exposed at the beginning of the treatment to a brake force, to adjust at least the quantity to be processed of the fiber strip of strips, the brake force being set automatically. The apparatus comprises a feed device for continuous feeding at least one fiber strip from a supply to a treatment unit in which the fed fiber strip is stretched and fluffed; a formatting unit for forming at least one wrapped separate fiber skein from the treated fiber strip; and a brake unit (4) arranged at the inlet in the treatment unit (1), which exerts an automatically settable brake force on the fiber strip, to adjust the quantity to be processed of each fiber strip to a predetermined value.

11 Claims, 7 Drawing Sheets

METHOD AND APPARATUS FOR PRODUCING FIBER SKEINS

The present invention relates to a method for producing a fiber skein or several wrapped fiber skeins, in particular for making filter skeins for cigarettes and other smokable, rod-shaped articles, and an apparatus for carrying out the method.

FIELD OF THE INVENTION

In the mass production of cigarettes and other such smoking articles, filters are used which are made from a band of cellulose acetate fibers or other suitable materials. This band, the so-called filter tow strip, is drawn off a supply bale, treated for further processing, and then collected in a formatting unit to a round fiber skein and provided with a wrapping material, e.g. a paper strip. This filter skein is lastly cut into single filter rods.

BACKGROUND OF THE INVENTION

A known method for producing filter rods for cigarettes and an apparatus suitable for carrying out this method are described in DE 41 09 603 A1. The known apparatus consists essentially of a treatment unit, in which a supplied filter tow strip is subjected, inter alia, to stretching and fluffing, an auxiliary unit for applying an additional filter material component on the treated filter tow strip, a formatting unit for forming a filter skein by collected and wrapping the treated filter tow strip with a wrapping material, and a cutting unit for successive severing of filter rods from the filter skein. With the known apparatus a single filter skein is produced.

In the treatment unit of the known apparatus a driven brake roll pair is provided, which draws the filter tow strip off a filter tow bale. According to the state of the art there are known also treatment sections which use at the inlet of the treatment section a non-driven brake roll pair. Such a treatment section is for example a commercial AF 2 of Körber AG, Hamburg. The treatment section described in DE 41 09 603 A1 with a driven brake roll pair has the following disadvantages: The farther the filter tow strip is drawn off from the bale, the longer will be the piece of filter tow strip between the bale and the drawing roll pair, owing to which the weight of the piece of filter tow strip between the bale surface and the drawing roll increases and hence the filter tow strip is stretched. In addition, with increasing drag length of the filter tow strip at high drawing speeds, the air friction acting on the filter tow strip becomes greater and greater, which also leads to a prestretching of the filter tow strip. This stretching means, however, that less and less weight of the filter tow strip per unit of time or per unit of length is fed to the drawing roll pair, that is, the fed quantity of filter tow strip varies at constant speed of the brake roll. This has an adverse effect on the produced filter skein, as its density also changes when the supplied amount of filter tow strip changes. If too little filter tow strip is supplied, the density or mass of the produced filter rods or filter skein will be insufficient, so that the produced filter skeins or rods are unusable and constitute scrap. A non-driven brake roll pair or a "dragged" brake roll partly compensates this disadvantage and further fluctuations deriving from the filter skein, e.g. curl index fluctuations, which would affect the quality of the filter skeins. In the cited treatment section AF 2, depending on the specification of the filter tow strip in processing, a brake force to be set at a constant value is applied on the dragged roll pair. This is evident from the brochure "Technische Information 2-01" the "Kabelkennlinie" (Cable Characteristic) of Rhodia AG, Edition January 1989. Control of the mass in the filter skein is obtained according to the state of the art by changing the feed speed of the driven rolls.

SUMMARY OF THE INVENTION

It is the object of the present invention to provide a method and respectively an apparatus for producing a fiber skein or several fiber skeins which permit higher productivity at equally good quality of the produced fiber skeins or filter skeins. In particular, the quantity of fiber strip or filter tow processed in the treatment unit of the apparatus is to be kept constant to the extend possible.

The solution of this problem consists of a method for producing at least one fiber skein, in particular for producing at least one filter skein for the production of filters for cigarettes and for other smokable rod-shaped articles, where at least one fiber strip, in particular a filter tow strip, is drawn off from a supply, the at least one drawn-off fiber strip is supplied to a following treatment in which the fiber strip is, inter alia, stretched and fluffed, the at least one treated fiber strip is then collected in a formatting unit to a fiber skein or filter skeins, which lastly are provided with a wrapping material, to form one or more continuous, wrapped fiber skeins, in particular filter skeins, the fiber strip or strips being subjected at the beginning of the treatment to a brake force to adjust the quantity to be processed and/or other properties of the fiber strip or strips, the brake force being set automatically.

Further a component part of the solution of the above problem is an apparatus for producing a fiber skein or simultaneously several wrapped fiber skeins, in particular for simultaneously producing two filter skeins for cigarettes and other smokable rod-shaped articles, from a fiber strip or several fiber strips, in particular a filter tow strip, the apparatus comprising: a feed unit for the continuous feeding of a fiber strip of simultaneously several fiber strips from a supply to a treatment unit in which the supplied fiber strip or strips are, inter alia, stretched and fluffed, a formatting unit for forming a fiber skein or simultaneously several wrapped, separate fiber skeins, in particular two filter skeins from the treated fiber strip or strips, and a brake unit, arranged on the entrance side in the treatment unit which exerts on the supplied fiber strip or strips an automatically settable brake force or automatically settable different brake forces, to adjust the quantity to be processed of each fiber strip to a predetermined value.

Accordingly, in the method of the invention for producing at least one fiber skein, in particular for producing at least one filter skein for the production of filters for cigarettes and other smokable rod-shaped articles, at least one fiber strip, in particular a filter tow strip, is drawn off from a supply and subjected to a further treatment in which the fiber strip or strips are, inter alia, stretched and fluffed. In treating the supplied filter tow strip or strips, they are first subjected to a brake force. This force is automatically controllable and sees to it that the length-related mass of the formed fiber skeins remains constant.

Due to the brake force exerted e.g. on a fiber strip, certain properties of the fiber strip can be compensated, which in turn affect the properties of the fiber skein. Such properties of the fiber strip are e.g. the curl index and the total titer.

The brake force on the fiber strip can be controlled manually. Preferably it is controlled automatically through a respective control system.

To permit automatic control of the brake force on the fiber strips, there is picked up and measured e.g. a characteristic value of the produced filter skeins. The quantity to be processed of the supplied fiber strip is then set as a function of the measured instantaneous value or actual value and of predetermined values, as e.g. a desired value for the respective measured characteristic value, by regulating the brake force on the fiber strip or strips.

Picking up and measuring a characteristic value of the produced filter skein or skeins or fiber skeins means in the context of the present invention that this measuring can be done both on endless filter skeins or fiber skeins as well as on finite filter rods.

With the method and apparatus of the invention, several fiber skeins, e.g. fiber strips drawn off from a bale or from several bales, can be produced simultaneously. Preferably at least one characteristic value for each of the simultaneously produced fiber skeins is measured, and from the measurement results and predetermined desired values a mean value is determined for the brake force. This mean brake force then acts on all fiber strips sent to the treatment.

Alternatively, the feed quantity for each of the fiber strips can be set individually through a correlated brake force. For this purpose there can be used for each drawn-off fiber strip, before it reaches the drawing roll in the treatment unit, a pressure-controlled brake roll pair through which the respective fiber strip passes.

With the method and apparatus according to the invention also a single filter skein can be produced from a single drawn-off fiber strip, a characteristic value, e.g. the density and hence the mass per length of the produced filter skein being measured and the quantity to be processed of the fiber strip being controlled and regulated as a function of the measurement result and of additional preset values via the brake force on the fiber strip.

As brake system for applying the brake force on the fiber strip, generally a brake roll pair or several such pairs can be used, through which a fiber strip runs in each instance. The rolls of these brake roll pairs are, as has been mentioned before, themselves not driven. There is provided a respective controllable setting device, which operates e.g. pneumatically, hydraulically or in another suitable manner and presses one of the brake rolls with a corresponding force toward the other roll of the pair to exert a brake force on the fiber strips running through the brake roll pair. The brake system may have e.g. two brake roll pairs if two fiber strips are to be treated in the treatment unit simultaneously, from which two fiber skeins are then to be produced by the subsequent processing steps. The two brake roll pairs may be "coupled", i.e. while there are two separate brake roll pairs, these pairs are actuated simultaneously by one and the same setting device. Thus the brake roll pairs produce identical brake forces on the fiber strips running through them.

As brake device may be used also at least one brake rod over which the fiber strips are guided, at least one of the brake rods being movable, to make the relative position of the brake rods variable, to be able to set the brake force on the fiber strips.

Alternatively, the brake system may have at least one brake plate over which the fiber strips are guided, the brake plate being movable to be able to set or to vary the brake force on the fiber strips.

By adjustment of the feed quantity and/or other properties of the fiber strips, a uniform quality of the produced filter skeins can be obtained even if the supplied fiber strips have relatively great deviations from the desired set values. In particular if within the fiber strip of a bale there are i.a. fluctuations of the curl index and/or the total titer, they can be compensated via the automatic control of the brake force without requiring manual resetting of the machine by the personnel. Lastly, by adjustment of the feed quantity of fiber strips to further processing, the scrap rate can be reduced, thus increasing the productivity of the filter skein production.

Increased productivity in the manufacture of fiber skeins can be achieved quite generally also by making several fiber skeins simultaneously, the simultaneously produced fiber skeins being produced from at least one continuously fed fiber strip and at least one characteristic value of the produced fiber skeins being measured and the feed quantity of fiber strip or strips being automatically controlled as a function of the measurement result.

With this method according to the invention several wrapped fiber skeins can be produced simultaneously from at least one continuously fed fiber strip. The quality of the fiber skeins is monitored by detecting and evaluating a characteristic value of the fiber skeins in order to set the feed quantity of fiber strip or strips by control of the brake force, so as to ensure e.g. uniform density or mass of the finished fiber skeins.

The apparatus according to the invention has for the simultaneous production of several wrapped fiber skeins a treatment unit which guides at least one fiber strip, specifically a filter tow strip, to a formatting unit which forms simultaneously several separate fiber skeins from the supplied fiber strips, which are wrapped with enveloping material. With this apparatus, which can produce e.g. simultaneously two fiber skeins, the productivity of the fiber skein manufacture can be doubled without requiring more personnel or more space for accommodating this double skein machine.

The apparatus according to the invention comprises a measuring device with which important properties and values of the fiber skeins or filter rods can be monitored during production. Such properties and quality parameters for fiber skeins or filter rods are e.g. their density or mass, their draw resistance and diameter.

As starting material of multi-skein production e.g. two fiber strips running side by side can be supplied simultaneously to a double skein machine or double skein filter rod machine. In this case the treatment unit sees to it that the feed quantity is controllable singly for each of the two fiber skeins. Preferably there may be used to this end individually controllable brake roll pairs, through which runs in each instance one of the fiber strips in the treatment unit to set the feed quantity for the further treatment automatically. By the brake force exerted by the roll pair on the fiber strip the feed quantity can be varied within certain limits, to be able to stay within the filter tolerances to be achieved. The brake roll pair consists of rubber-coated roll and a steel roll. The braking of the fiber strip occurs by the flexing work of the rubber-coated roll on the steel roll, the fiber strip driving the rolls.

If, however, the two separately drawn-off fiber strips have individually greatly different properties, as e.g. a greatly different total titer or curl index, it may become difficult to compensate the differences between the fiber strips with the individually controllable brake roll pairs. The result would be that the simultaneously produced fiber skeins differ in their properties and at worst the desired tolerances would be exceeded. For this reason, in filter rod production, preferably a multiple-width filter tow strip is used which has a tear line to make it divisible.

Preferably a double-width fiber strip is used which is parted at its central tear line into two single-width fiber strips in the treatment unit. The separated single-width fiber strips or respectively the two strip halves of the wide fiber strip drawn off a bale, advantageously have essentially the same material properties, in particular the same quantity or mass per length, so that overly great differences in the important material properties are relatively avoided and thus the tolerances of the fiber skeins in double fiber skein production can be met reliably.

The preferred double-width divisible fiber strip is therefore characterized by the fact that all quality-relevant parameters for the fiber skein production can, by reason of its production, differ only insignificantly in the two fiber strip halves, as both halves of the double-with fiber strip are produced in the same operation.

The use of a double-width fiber strip drawn from a single bale has advantages in particular when the double-width fiber strip has been completely drawn off, i.e. The bale must be changed. With the double-width fiber strip then only one bale need be replaced and threaded into the double-skein machine to be able to continue the operation. This also constitutes an improvement over the alternative embodiment of the present invention where two separate fiber strips are drawn off from a bale for each. In that case the bales basically do not expire simultaneously, so that in principle two machine stops are necessary, resulting in greater cost of personnel and more scrap. This is avoided when using the double-width fiber strip with one bale.

The precise construction of the double-width, divisible fiber strip used and of additional multi-width and asymmetrical fiber strips is described in the co-pending application "Multi-width fiber strips and a method and apparatus for its production", originating from the same applicant as the present application, and to which reference is here made expressly.

To achieve fast quantity control with the brake system, continuous monitoring e.g. of the density or mass or of the draw resistance of the fiber skeins or filter rods is of advantage. Suitable for this is a comparative skein density measurement or an on-line draw resistance measurement.

Another advantageous development of the invention consists in that as characteristic value of the produced fiber skeins their mass is detected and determined. Depending on the mass values measured, the feed quantity can be set via the brake force on the drawn-off fiber strips.

In an advantageous variant of the invention, the draw resistance of the filter rods is determined as characteristic value of the fiber skeins produced. As a function of the draw resistance found, the feed quantity of fiber strip is regulated with the brake system in the treatment unit in the sense of stabilizing the draw resistance.

The characteristic values mass and/or draw resistance of the fiber skeins or filter skeins produced are preferably picked up on-line on the apparatus according to the invention. By the invention the determining properties of the fiber skeins can be optimized and durably maintained in the production. By the adjustment or control of the quantity via the measurement of the characteristic value, as e.g. the draw resistance, it is then ensured that the draw behavior of the cigarettes is not impaired when smoking through the filter.

Additional advantages and possibilities of use of the present invention can be seen from the following description of a form of realization given as example in conjunction with the drawings.

A BRIEF DESCRIPTION OF THE DRAWINGS

Figure 1:
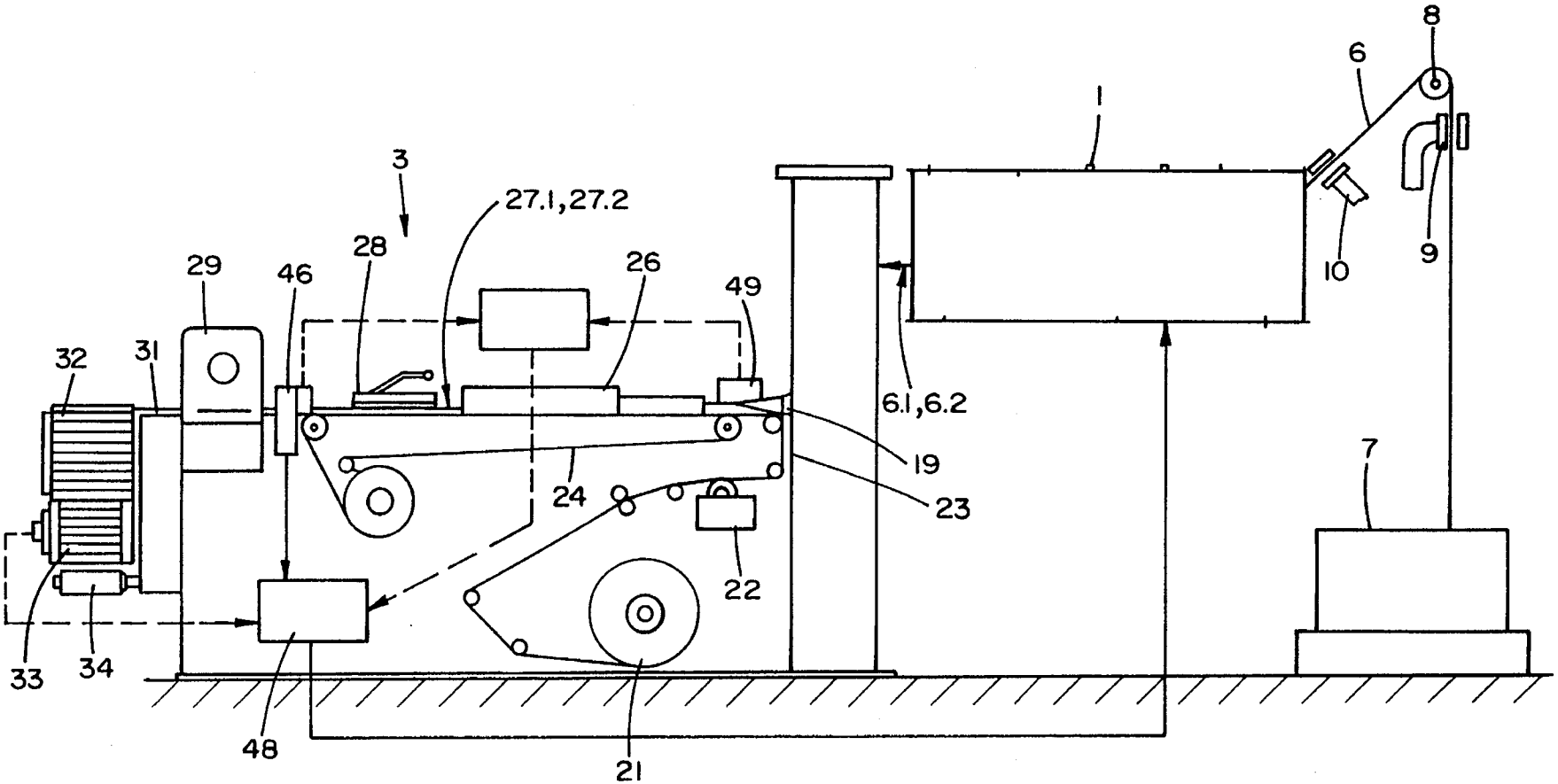
FIG. 1 shows schematically an embodiment of the apparatus according to the invention for carrying out the method of the invention, the apparatus being designed as double filter skein machine.
Figure 3:
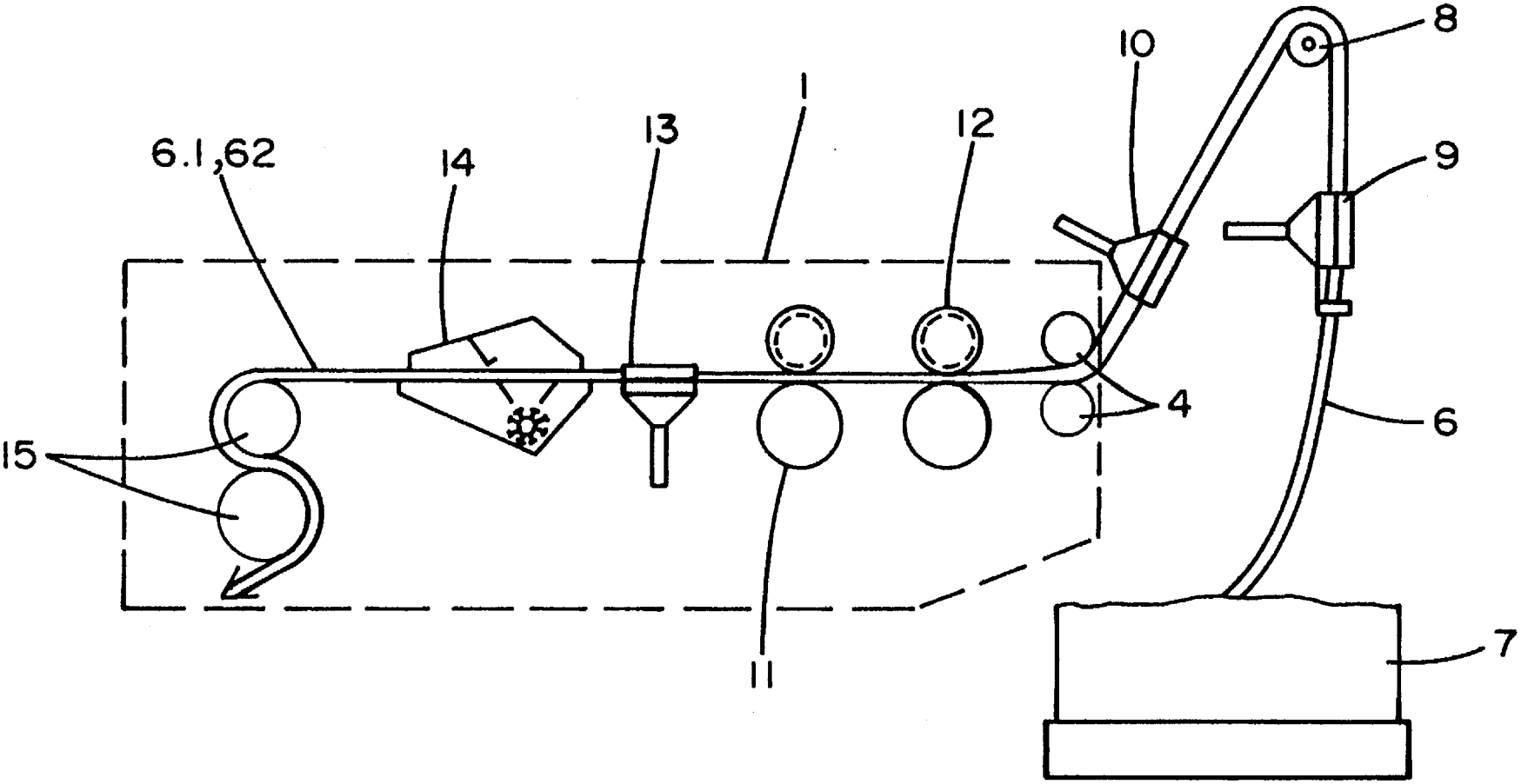
Figure 4:
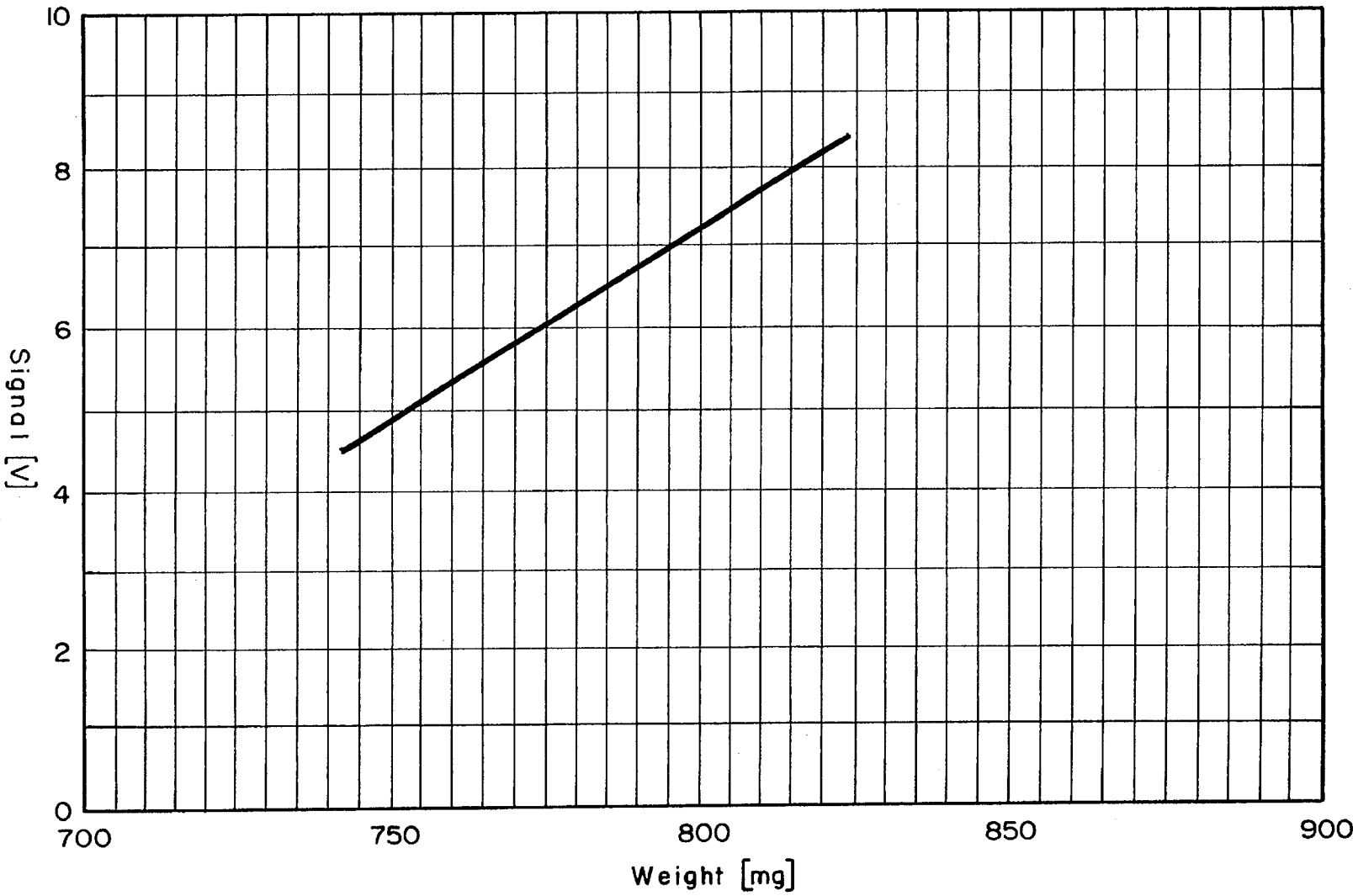
Figure 5:
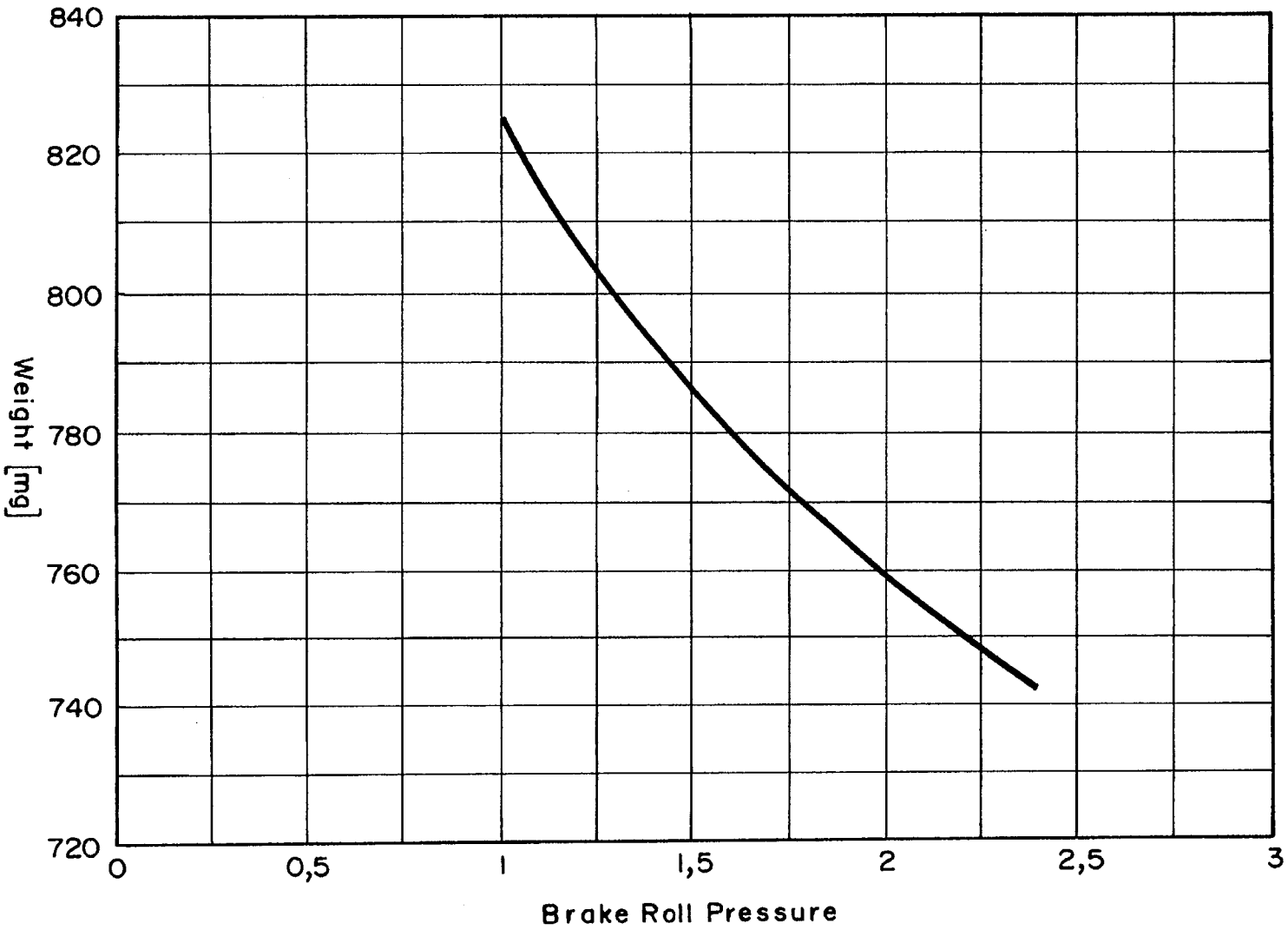

FIG. 3, a schematic side view of the treatment unit in the apparatus per FIG. 1, but without separating device;

FIG. 4, a function diagram showing a generated signal as a function of the weight of a filter skein; and FIG. 5, a function diagram showing the dependence of the weight of the filter skein on the brake force (brake roll pressure) applied by a brake unit in the apparatus per FIG. 1.

Figure 6:
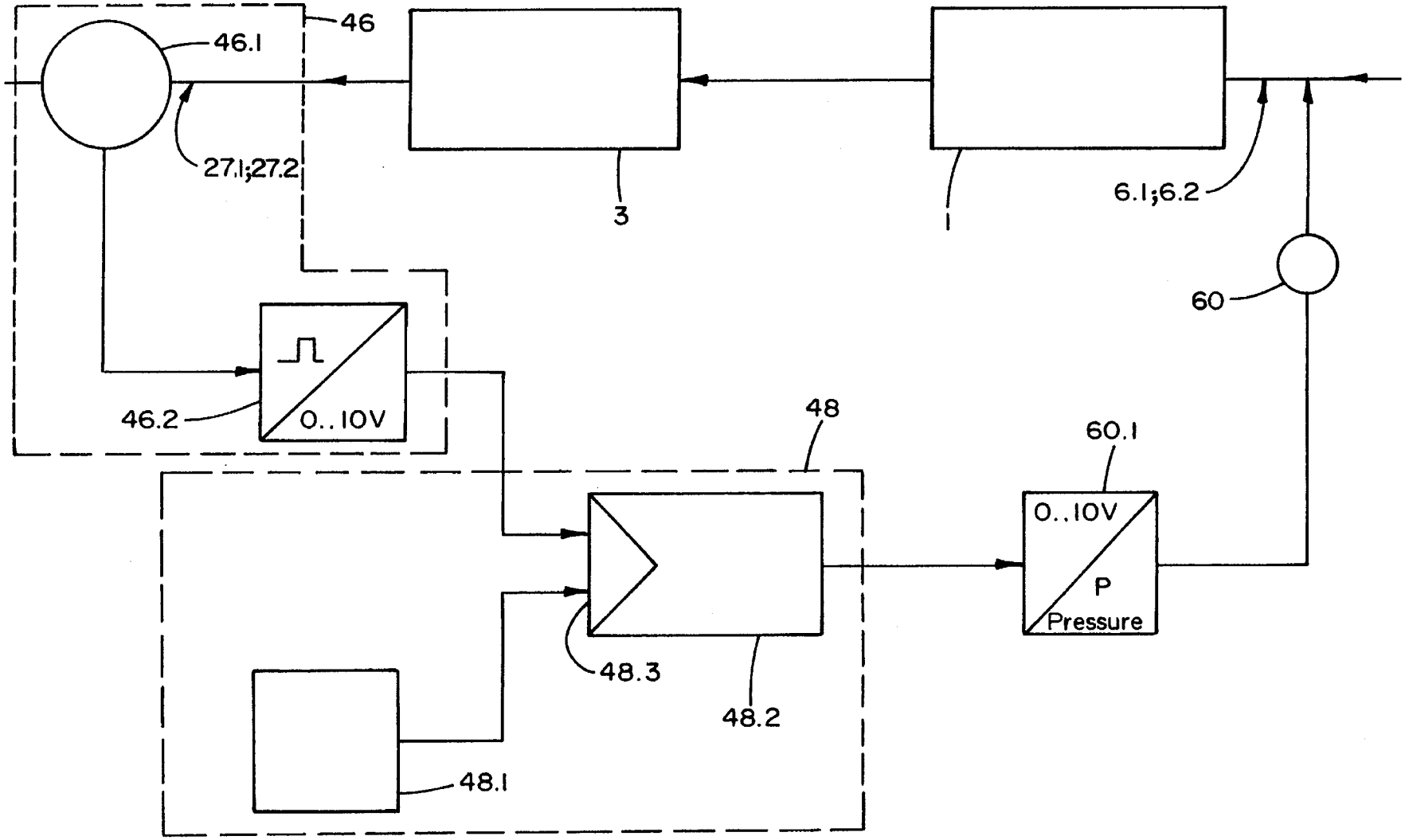
Figure 7:
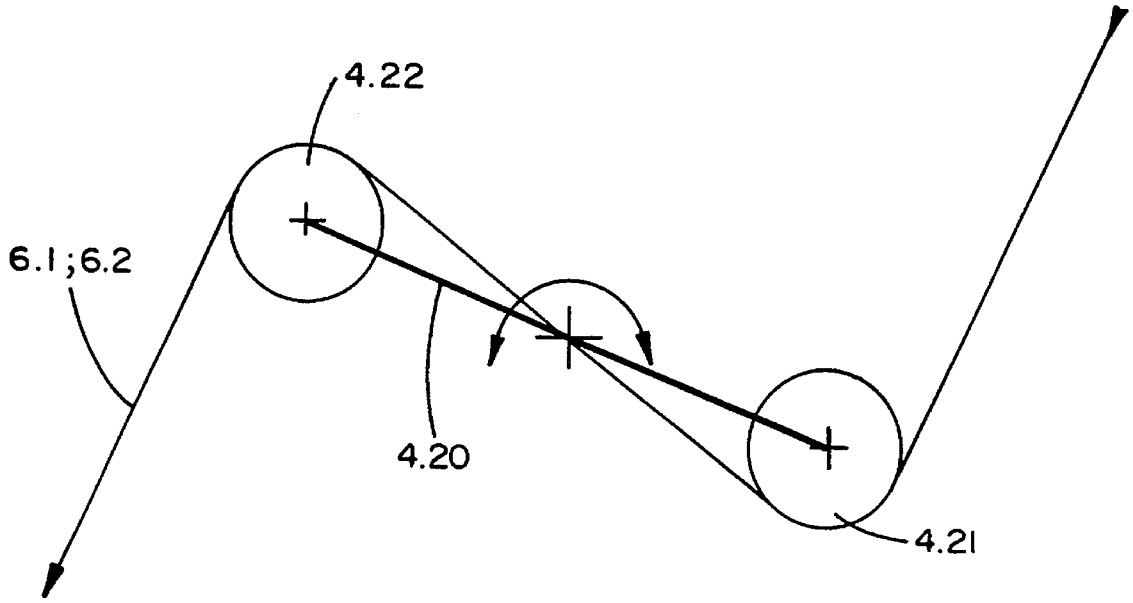
Figure 8:
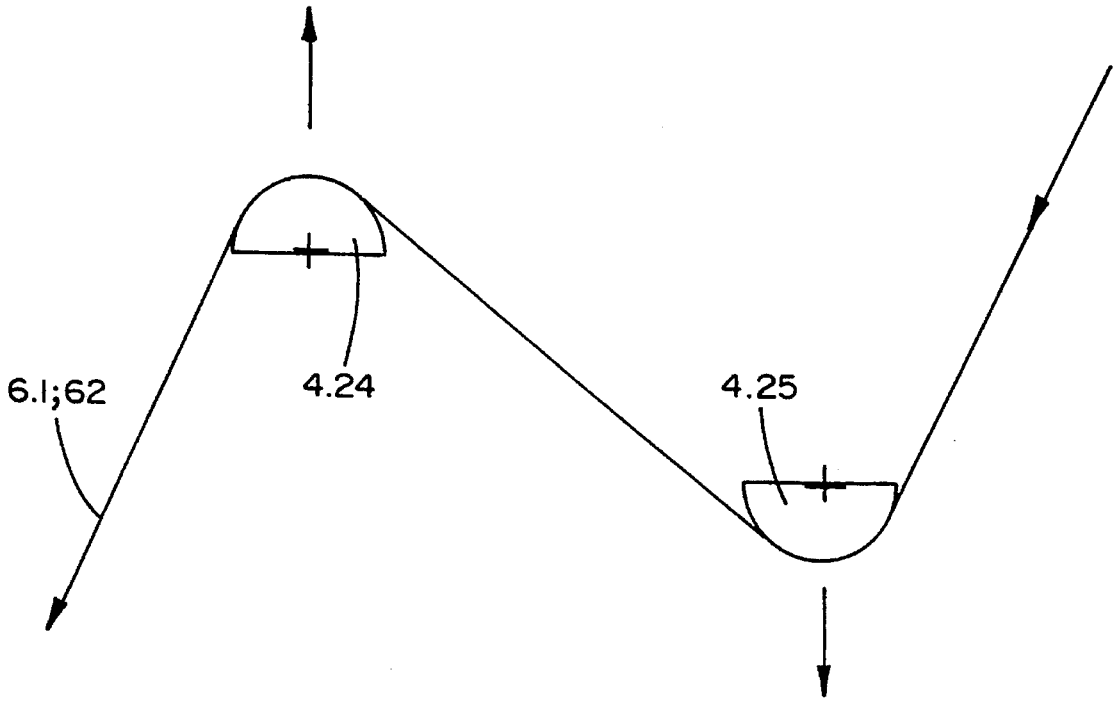

FIG. 6, a block diagram showing essential devices of a control circuit for regulating the supply quantity of filter tow strip via the brake force on the filter tow strip;

FIG. 7, a schematic side view of a brake system for use in the form per FIG. 1, the brake system using brake rods instead of brake rolls; and FIG. 8, a schematic side view of another alternative brake system which can be used in the embodiment of the present invention per FIG. 1, the alternative brake system using brake plates instead of brake rolls.

In FIG. 1, an apparatus according to the invention as double filter skein machine for simultaneously producing two filter skeins, in particular for the production of filters for cigarettes and comparable smokable articles, is represented in a schematic side view.

The apparatus according to the invention comprises essentially an arrangement 8, 9, 10, through which a double-width divisible filter tow strip is supplied to a treatment unit 1. Unit 1 is followed by a formatting unit 3 for simultaneously producing two wrapped filter skeins from the drawn-off and treated filter tow strip.

Treatment unit 1 comprises a brake system 4, a driven stretch roll pair 12, a second driven stretch roll pair 11, a spreader nozzle 13, a spray box 14, and a deflecting roll pair 15 (FIG. 3).

Figure 2:
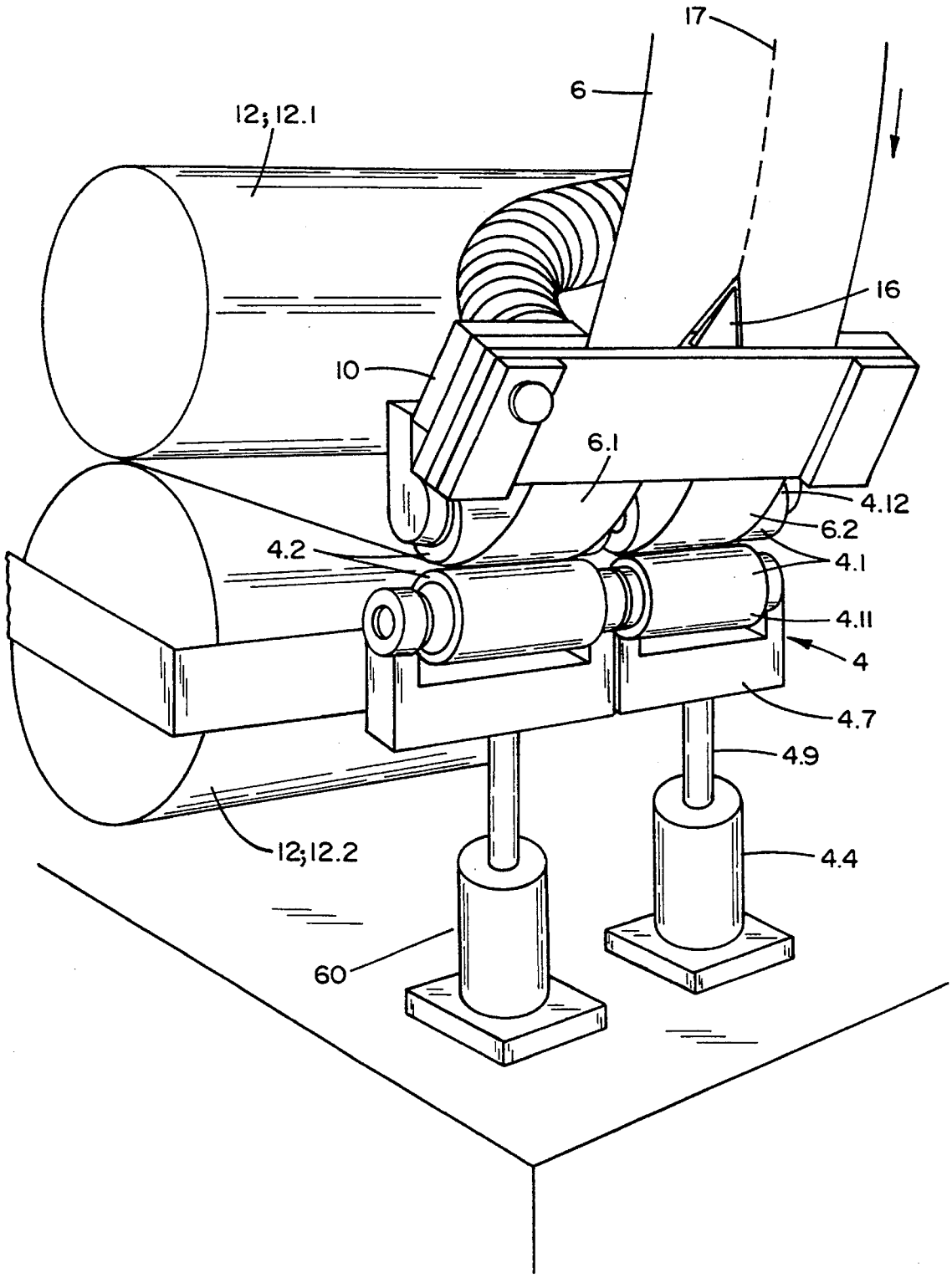
FIG. 2 is a detailed view of the treatment unit used in the embodiment.

According to FIG. 2, the brake system 4 of treatment unit 1 comprises two brake roll pairs 4.1 and 4.2 arranged side by side and a setting device 60 composed of two pneumatic cylinder-piston units, each comprising a cylinder 4.4 and an associated piston 4.9. At the free end of piston 4.9 a U-shaped support part 4.7 is fastened, in which is mounted a correlated brake roll 4.11 of the brake roll pair 4.1. By actuation with compressed air the pneumatic cylinder-piston unit can press the roll 4.11 mounted in the U-shaped support 4.7 upward against a second roll 4.12 of the roll pair 4.1, to adjust the brake force on the filter tow strip running between the rolls of the roll pair. In the present form of realization, the two brake roll pairs 4.1 and 4.2 are "coupled", i.e. their correlated setting units are pressurized with the same compressed air (the respective compressed air lines and the pneumatic system necessary therefor are known and need not be represented further), in order that the same brake force acts on the filter tow strips at both brake roll pairs 4.1 and 4.2.

The two single-width filter tow strips 6.1 and 6.2 are obtained by means of a separating device 16, which may be designed e.g. as a parting wedge or parting plate and which is arranged outside the brake rolls, by separating a double-width divisible filter tow strip 6. Strip 6 is drawn off continuously from a bale 7 by the first stretch roll pair 12 of treatment unit 1, the double-width filter tow strip being guided after removal from bale 7 on its way to the stretch roll pair 12 over a deflection roller 8 and passing two air nozzles 9 and 10 which serve to spread and loosen the double-width filter tow strip. Lastly, after the parting device 16, the single-width filter tow strips 6.1 and 6.2 pass through the brake roll pairs 4.1 and 4.2, in order to reach the stretch roll pair 12. After passing the stretch roll pair 12, the two single-width filter tow strips 6.1 and 6.2 get to the second stretch roll pair 11 of treatment unit 1, the two filter tow strips being stretched between the two stretch roll pairs 12 and 11, this being brought about by the setting of a differential speed between the driven stretch roll pairs. After the second stretch roll pair 11, the single-width filter tow strips 6.1 and 6.2 are supplied to a dual spreader nozzle 13, where they are spread uniformly for subsequent treatment in spray box 14. In spray box 14 the two filter tow strips 6.1 and 6.2 are provided with a softener, e.g. triacetin, and are then supplied to a deflection roll pair 15. The two stretch roll pairs 11 and 12 and the deflection roll pair 15 are driven, whereas the two brake roll pairs 4.1 and 4.2 of the brake unit 4 in the treatment unit 1 are not driven.

The stretch roll pairs 11 and 12 together with the devices 13, 14 and 15 form a single stretch mechanism which in processing the double-width filter tow strip or respectively in the simultaneous treatment of the two single-width filter tow strips can be kept essentially without an major modification and need not be provided in duplicate.

The two filter tow strips 6.1 and 6.2 go to the dual inlet funnels 19 of the formatting unit 3, where the two single-width filter tow strips are collected to a filter skein and are provided on [sic] a wrapping strip 23 drawn from bobbins 21 and provided with glue by means of a gluing device 22. The wrapping material strip 23 and the respective filter skein pass onto a format band 24 of the formatting unit 3, which has two formatting belts running parallel. Each of the two formatting belts leads the components lying on it through a format 26, which is designed as double format and which places the respective wrapping material strip 23 around the associated filter skein, whereby wrapped filter skeins 27.1 and 27.2 are formed. The wrapped filter skeins thus produced, running side by side, pass through a double seam plate 28, in which the glue seams of the wrapped filter skeins 27.1 and 27.2 running side by said are sealed. Thereafter the parallelly running filter skeins are cut by a cutter 29 continuously into filter rods 31 running side by side, which are transferred into one of two deposit drums 12, in which they are deflected in a cross-axial transport direction, where they are transferred via one of two test drums 33 onto a delivery belt 34, whence they are sent to further processing or intermediate storage.

The filter-making machine has a measuring device 46 known per se, with which a characteristic value of the filter skeins 27.1 and 27.2, here the density or mass of the filter skeins, is determined. The measuring device 46 is connected with a control system 48 which furnishes the mass data as signal. As measuring device 46 may be used e.g. a radioactive radiation source (beta ray tube). This measuring device is described in detail in DE OS 2208944, to which reference is here expressly made in this respect.

Optionally the measuring device may comprise an additional measuring means known per se for determining a second characteristic value of the filter skeins, namely the draw resistances of the severed filter rods 31 and hence of the filter skeins 27.1 and 27.2. For this purpose a test drum 33 is used, with which the draw resistances of the filter rods of the individual filter skeins 27.1, 27.2 are measured. Measurement of the draw resistance of filter rods with a test drum is know per se. In this connection reference is made for example to DE-OS 4109603 A1. A more detailed elucidation of the test drum and of the respective measuring process is therefore not made here. Test drum 33 is connected with the control system 48, which as a function of the draw resistance data and mass data generates control signals by which the two brake roll pairs 4.1, 4.2 of brake unit 4 are actuated for setting the brake force, to adjust the quantity to be processed of the single-width fiber strips 6.1, 6.2. Instead of the double test drum 33, a measuring means 49 may be provided for the draw resistance measurement for determining the draw resistances of the individual filter skeins. Such a measuring means is referred to e.g. in DE OS 4109603 A1. The draw resistance measurement just mentioned can be used in addition to the density measurement or as an alternative measurement and are therefore shown in FIG. 1 in broken lines with respect to their output signals.

As measuring means 46 for the density of the finished filter skeins a double measuring head may be provided which operates with a radiation which penetrates the fiber skeins. The double measuring head may use for example beta radiation.

In the following it is to be assumed that only the density or mass of the produced filter skeins 27.1 and 27.2 is picked up and determined by the measuring device 46, and by the control device 48—which may comprise e.g. a microprocessor or micro-computer with ROM, RAM, CPU and respective input/output units—only the density signal associated with the weight of the filter skeins is evaluated for actuating the brake unit 4 in the treatment unit 1.

FIG. 4 shows the functional relationship between the mass of the filter skeins 27.1, 27.2 and the output signal of the measuring device 46. As can be seen from FIG. 4, there is a linear relationship between the found mass and the density signal. The control device 48 evaluates the arriving density signals for the two filter skeins 27.1 and 27.2, forms a mean of the signals, and compares this actual value to a stored desired value SOLL for the density of the filter skeins. If the comparison shows that the actual mass of the filter skeins 27.1 and 27.2 is lower than the desired value SOLL, the control device 48 furnishes and electric control signal to the setting device in the brake unit 4, which transforms this control signal into a corresponding stroke of the cylinder-piston units of the setting device 60, that is, in this case the pistons of the pneumatic setting units are taken back a little to lower the brake force, in order to increase the quantity to be processed of the filter tow strips 6.1 and 6.2. If the comparison in the microcomputer-controlled unit 48 shows that the found mass of the two filter skeins 27.1 and 27.2 is greater than the desired value SOLL, the control unit 48 generates a corresponding control signal which causes the pneumatic setting units in the brake unit 4 to increase the brake force on the two fiber strips 6.1 and 6.2 between the two brake roll pairs 4.1 and 4.2 in order to reduce the supplied quantities of the two fiber strips 6.1 and 6.2. The control unit 48 determines the respective control signal e.g. on the basis of a stored characteristic representing the relationship between the mass of the produced filters skeins 27.1, 27.2 or the found means value for these filter skeins and the brake roll pressure or brake force. A typical characteristic curve for this relationship can be seen in the function diagram of FIG. 5.

To clarify the above described controlling and regulating sequences, FIG. 6 represents a control circuit in a block diagram showing the essential devices participating in the control.

The filter skeins 27.1 and 27.2 simultaneously produced by the formatting unit 3 and running side by side are scanned by means of a double measuring head 46.1 of the measuring device 46, to pick up the density or mass of the filter skeins 27.1 and 27.2. The double measuring head furnishes a frequency-modulated signal, which is converted by a frequency/voltage converter into an electrical signal. The electric signal is compared with the desired value SOLL delivered by a set point transmitter 48.1. The comparator 48.3 delivers the comparison result to a regulator 48.2, which generates the above-mentioned electric control signal. As regulator 48.2 may be used e.g. a conventional PID controller or, as mentioned before, a microprocessor or microcomputer, which then assumes, besides the regulator function, also the comparison function of the comparator 48.3 and the function of setpoint transmitter 48.1. The devices 48.1, 48.2 and 48.3 are contained in the control unit 48. The electric control signal is delivered via respective lines or cabling to a voltage/pressure converter 60.1, which converts the supplied electric control signal to a corresponding pressure signal or respectively to a pressure for actuating the pneumatic setting unit(s) in the setting device 60, to set the brake force on the supplied filter tow strips 6.1 and 6.2 before the filter tow strips are guided to the next treatment unit 1 and then to the formatting unit 3. The object of the control is to adjust the feed quantity of filter tow strips 6.1 and 6.2 to a constant value, which is given by the desired value SOLL generated by the setpoint transmitter 48.1 of the control unit 48.

As an alternative to embodiment FIG. 1, the brake unit 4 may have as alternative means brake rods 4.22 and 4.21, shown schematically in FIG. 7 in side view. Between the brake rods 4.21 and 4.22, a holder 4.20 is arranged, at the ends of which the brake rods 4.22 and 4.21 are fastened. Holder 4.20 is rotatable about an axis extending parallel to the axes of the brake rods 4.22 and 4.21. In FIG. 7 a direction of rotation of holder 4.20 is indicated by the curved double arrow. Consequently, upon rotation, holder 4.20 moves parallel to a plane perpendicular to the axis of rotation and to the axes of the brake rod 4.21 and 4.22. As drive for the rotatable holder 4.20 of the present role brake per FIG. 7 an electric, pneumatic, or hydraulic drive mechanism may be used. By rotation of the holder, the position of the brake rods 4.22 and 4.21 is changed, so that also the looping angle of the filter tow strips on the brake rods changes, which are guided over the brake rods, as shown in FIG. 7, and accordingly a different brake force acts on the filter tow strips. Thereby the brake force can be varied via a correspondingly designed setting device 60 by means of the brake unit according to FIG. 7.

In FIG. 8 is shown another alternative design of the brake unit 4 in the embodiment of the invention per FIG. 1. Here two brake plates 4.24 and 4.25 of semicircular cross-section are used as brake unit 4. The two brake plates 4.24 and 4.25 are arranged offset in spaced relation to each other and displaceable in opposite direction through a drive mechanism not shown, the directions of movement of the brake places 4.24 and 4.25 being indicated in FIG. 8 by arrows. The filter tow strips 6.1 and 6.2 are guided around the brake plates 4.25 and 4.24 in this sequence in running direction of the filter tow strips 6.1 and 6.2. With decreasing distance between the two brake plates 4.24 and 4.25 in the direction of the movement arrows of the brake plates shown in FIG. 8, the looping angle of the filter tow strips 6.1 and 6.2 around the brake plates 4.24 and 4.25 decreases, and the lower will be the brake force acting on the filter tow strips 6.1 and 6.2. Thus also embodiment of the brake unit 4 per FIG. 8 the brake force on the fiber strips can be varied through an appropriate setting device 60.

We claim:

1. A method of producing at least two filter skeins for cigarettes and other smokable rod-shaped articles, from at least one filter tow strip which comprises the steps of:

(a) drawing said at least one filter tow strip, from at least one supply, and cutting said filter tow strip to obtain at least two filter tow strips, (b) feeding said filter tow strips to a treatment in a treatment unit;

(b1) at the beginning of said treatment unit, subjecting said at least tow filter tow strips to a brake force by means of idle rollers to adjust at least the quantity of said filter tow strips to be processed, the brake force being set automatically, and (b2) afterwards, stretching and fluffing said filter tow strips, (c) after said treatment, collecting said treated filter tow strips from step (b) in a formatting unit to form at least two round filter skeins and providing said at least two round filter skeins with an enveloping material to from at least two continuous, wrapped filter skeins, (d) detecting and measuring a characteristic value of said wrapped filter skeins from step c), to obtain an actual value of said characteristic value, and (e) controlling and regulating said brake force as a function of said obtained actual value from step (d) and of a predetermined desired value of said characteristic value at the beginning of said treatment in step (b1), prior to said stretching step (b2), the brake force acting on said at least two filter tow strips, and wherein during said step (d) results are obtained and during said controlling and regulating step (e) the quantity to be processed of said at least two filter tow strips is regulated as a function of said results by regulating the brake force on said filter tow strips, whereby a quantity of each of the filter tow strips being processed is maintained essentially constant.

2. The method according to claim 1, wherein said filter tow strip is subdivided into several single strips in step (a).

3. The method according to claim 1, wherein during said detecting and measuring step (d) said characteristic value is 1) the density; 2) the mass per unit length or 3) the draw resistance.

4. An apparatus for producing at least two filter skeins for cigarettes and for other smokable rod-shaped articles, from at least one filter tow strip and to obtain an essentially constant value of the quantity of said at least one filter tow strip to be processed which comprises:

(a) feeding means for continuous feeding at least one filter tow strip and means for cutting said filter tow strip to obtain at least two filter tow strips and for feeding said at least two filter tow strips to a treatment unit, (b) said treatment unit having an inlet side and comprising, (b1) a brake unit comprising idle rollers arranged on said inlet side in said treatment unit, said brake unit exerting a brake force on said at least two filter tow strips, to adjust the quantity to be processed of said at least two filter tow strips to a predetermined value, (b2) stretching means arranged downstream of said brake unit providing stretching of said at least two filter tow strips, (b3) fluffing means arranged downstream of said stretching means providing fluffing of said at least two stretched filter tow strips, (c) a formatting unit for forming at least two filter skeins, from said at least two filter tow strips, treated in said treatment unit (b), (d) a measuring device for detecting and measuring at least one characteristic value of said at least two filter skins, to provide respective measurement signals which are assigned to an actual value of the characteristic value, (e) means for providing said actual value of the characteristic value from said measurement signals, for comparing said actual value with a predetermined desired value and for providing an electrical control signal, and (f) a setting device for controlling the amount of said exerted brake force applied by said brake unit depending on said electrical control signal to control and regulate automatically said quantity of said at least one filter tow strip to be processed.

5. The apparatus according to claim 4 wherein said measuring device determines the characteristic value for said at least two filter skeins and delivers respective measurement signals to said setting device, said setting device actuates the brake unit in such a way that the quantity to be processed of said single-width filter tow strip is adjusted automatically.

6. The apparatus according to claim 4 wherein said brake unit has several non-driven mutually separated brake roll pairs through which run at least two filter tow strips, and said brake roll pairs exert a brake force on said filter tow strips passing through them, the brake force being adjustable.

7. The apparatus according to claim 4, wherein the brake unit has two brake roll pairs and wherein said two brake roll pairs are coupled and exert an identical brake force.

8. The apparatus according to claim 4, wherein said brake unit comprises a multiple width, double-width, or single-width brake not driven roll pair.

9. The apparatus according to claim 4, wherein said brake unit comprises two brake rods, said at least two filter tow strips are guided over said brake rods, at least one of said brake rods is movable, whereby the position of the brake rods relative to each other can be changed, to be able to adjust the brake force on said at least two filter tow strips.

10. The apparatus according to claim 4, wherein said brake unit has two brake plates, said at least two filter tow strips are guided over said brake plates, and at least one of said brake plates is movable, to be able to adjust or change the brake force on said at least two filter tow strips.

11. The apparatus according to claim 4 wherein said measuring device determines as characteristic value 1) the draw resistance, 2) the density or 3) the mass per unit length of said at least one filter skein produced by said formatting unit.

* * * * *